US005511485A

United States Patent [19]

Romani et al.

[11] Patent Number: 5,511,485

[45] Date of Patent: Apr. 30, 1996

[54] METHOD AND APPARATUS FOR STABILIZING A SUBGRADE WITH ADDITIVES ADDED THROUGH THE SCARIFIER

[75] Inventors: Ernesto Romani; Livio Abbruzzese, both of Rome, Italy; Josef Theurer, Vienna, Austria; Herbert Wörgötter, Gallneukirchen, Austria; Friedrich Oellerer, Linz, Austria

[73] Assignee: Franz Plasser Bahnbaumaschinen-Industriegesellschaft m.b.H.

[21] Appl. No.: 297,140

[22] Filed: Aug. 29, 1994

[30] Foreign Application Priority Data

Aug. 31, 1993 [AT] Austria ..... 1748/93

[51] Int. Cl.[6] ..... E01B 27/06

[52] U.S. Cl. ..... 104/2; 238/2; 37/104; 171/16

[58] Field of Search ..... 104/2, 7.1; 238/2; 37/107; 171/16

[56] References Cited

U.S. PATENT DOCUMENTS

| | | | |
|---|---|---|---|
| 3,872,929 | 3/1975 | Theurer et al. | 104/2 |
| 4,397,241 | 8/1983 | Newman | 104/2 |
| 4,400,897 | 8/1983 | Scheuchzer et al. | 37/104 |
| 4,451,180 | 5/1984 | Duval | 238/2 |
| 4,479,439 | 10/1984 | Theurer et al. | 104/2 |
| 5,257,580 | 11/1993 | Theurer et al. | 104/2 |

FOREIGN PATENT DOCUMENTS

| | | | |
|---|---|---|---|
| 135478 | 8/1984 | European Pat. Off. | 104/2 |
| 1784659 | 8/1978 | Germany | 104/2 |
| 474618 | 8/1969 | Switzerland | 104/2 |
| 595512 | 2/1978 | Switzerland | 104/2 |

*Primary Examiner*—Matthew C. Graham
*Assistant Examiner*—S. Joseph Morano
*Attorney, Agent, or Firm*—Henry M. Feiereisen

[57] ABSTRACT

An arrangement for installing a protective layer between a subgrade and a layer of ballast of a track bed includes an excavating unit to remove ballast from underneath the track and a subgrade stabilizing unit by which additives are disposed directly over the exposed subgrade and blended underneath the track with the subgrade for formation of a protective layer following a leveling and compacting process. Removed and cleaned ballast is then laid by a conveyor over the new protective layer.

21 Claims, 2 Drawing Sheets

METHOD AND APPARATUS FOR STABILIZING A SUBGRADE WITH ADDITIVES ADDED THROUGH THE SCARIFIER

BACKGROUND OF THE INVENTION

The present invention refers to a method of and apparatus for rehabilitating a track bed. In particular, the present invention refers to an improved method of stabilizing the subgrade of a track, including a continuous removal of ballast from underneath the track to expose the subgrade while simultaneously blending additives to the exposed subgrade underneath the track for formation of a new protective layer through subsequent leveling and consolidation, with removed and possibly cleaned ballast being subsequently laid over the protective layer. This invention also related to an improved arrangement for carrying out this method.

Austrian Pat. No. 294,898 discloses an arrangement for simultaneous cleaning ballast of track beds and stabilizing the subgrade. The arrangement includes an elongated machine frame which is supported by bogies on its ends. Approximately in the center of the machine frame is a track lifting device which is preceded in operating direction by two like excavating chains mounted to the machine frame and guided for placement underneath the track. Ballast is picked up by the leading one of the excavating chains for transport of ballast to a screening unit for removal of fouling material while the cleaned ballast is returned to the track by a conveyer and laid via a spreader over the track bed. The trailing second excavating chain cuts and receives subgrade of a certain layer thickness. Excavated soil is elevated and unloaded on a conveyer belt by which ballast residues received from the screen are transported at the same time. Subsequently, this material is discharged either outside the track or deposited on a conveyer which is additionally supplied with additives and cement from a container. The resulting mixture of soil, ballast residues, additives and cement is laid over the track bed via a flexible boom in operating direction before the discharge area of the cleaned ballast and blended by a motor-driven rotating member. Subsequently, the mixture is compacted and stabilized by a vibrating plate compactor. This method is relative cumbersome and the arrangement is of complicated structure so as to be highly susceptible to failures and prone to malfunction.

European Patent specification EP 0135478A1 discloses a method for stabilizing soft soils for improving its support capability. After removing the layers covering the subgrade, the underlying ground is mixed on site with cement and lime as well as with water and other substances to reinforce and promote stability.

Swiss Pat. No. 595,512 discloses a method of and apparatus for stabilization of the surface area of a subgrade by disposing an unfoamed diffusable high resistance foam over the subgrade and expanding the foam to form a load-carrying band without any gaps.

SUMMARY OF THE INVENTION

It is an object of the present invention to provide an improved method for simplifying a stabilization of the subgrade of a track by forming a protective layer in a more rapid and simpler manner.

It is another object of the present invention to provide an improved arrangement for carrying out a method of stabilizing the subgrade of a track by installing a protective layer in a more rapid and simpler manner.

These objects and others which will become apparent hereinafter are attained in accordance with the present invention by directly disposing additives over the exposed subgrade and blending the additives with the subgrade underneath the track.

By disposing additives directly over the subgrade, the construction of a respective arrangement becomes considerably less complex because the top layer of the subgrade can be rapidly blended with the additives so that the performance of a ballast cleaning device is not adversely affected at all when being operated concurrently with the subgrade stabilization. Due to the reduced complexity created through blending additives directly upon the subgrade, a conventional ballast cleaning device can easily be retrofitted and utilized to carry out the method according to the invention by simply attaching various additional units in the area between the excavating chain and the ballast discharge.

Suitably, the top layers of the subgrade are scarified immediately following the removal of ballast, with the additives being introduced in a same working step into the formed cracks, to thereby ensure a particular intimate and uniform blending of the components and to increase the efficiency of the mixing process. Materials for the additives include cement which is initially introduced into the cracks of the planum. In addition, a mixture of water and lime may be subsequently sprayed onto the surface of the subgrade, with the top layer containing cement and lime being blended, cleaned and compacted for formation of a protective layer for the subgrade. In this manner, a protective layer in form of a rigid plate is obtained which is characterized by a considerable compressive strength of about 5–7 kg/cm$^2$. This layer of substantial load-carrying capability offers an optimum support for installation of the ballast bed for the track. The addition of concentrated lime also simplifies its transport and results in a good bond of the clayey water as well as possible organic substances.

According to another feature of the present invention, the moisture content of the soil in the area of the scarified subgrade is continuously measured to enable an automatic control of water being added. Thus, irrespective of the composition of the subgrade, an optimum and absolutely uniform setting of the materials forming the protective layer is ensured and the formation of a too dry or too liquid mixture is essentially eliminated.

It is also possible to lay upon the compacted protective layer a plastic sheet to prevent intermigration between the subgrade and the cleaned ballast deposited upon the plastic sheet while yet providing an effective drainage of the ballast bed. The plastic sheet is a water-impermeable membrane by which a penetration of water in possibly existing cracks of the protective layer is eliminated. Sheets of this type are generally known per se and may be made of any suitable plastic material.

In accordance with the present invention, an improved method for stabilizing the subgrade of a track is carried out by an arrangement which includes a vertically adjustable mixing unit positioned immediately rearwardly of the excavating chain in operating direction and provided with rotatable mixing elements which are immersable in the subgrade. In this manner, the components necessary for rehabilitating the subgrade are mounted to the machine frame ready for use, without interfering with the actual ballast cleaning device. An immersion of the mixing elements allows a simplified and rapid blending without requiring time consuming withdrawal and transport of the top subgrade layer being treated.

Suitably, a plurality of scarifying teeth are mounted immediately in front of the mixing unit in side-by-side relationship transversely to the track, with the scarifying teeth being vertically adjustable and suitably mounted to the machine frame. The provision of such scarifying teeth leads to a uniform and simultaneous loosening of the exposed subgrade over its entire width and in particular to a tearing up to a desired depth which can be best suited depending on prevailing conditions and may amount under normal circumstances to about 10 cm. By attaching the scarifying teeth to a carrier frame of the mixing unit, a particular ruggedness and yet substantial stability under load of the overall unit is accomplished.

In order to ensure a blending of additives across the entire width of the subgrade, the mixing unit is part of a relative simple swingable device which includes a swivel arm having one end swingably mounted to the carrier frame of the mixing unit. Rotatably mounted to the other end of the swivel arm are the mixing elements. Suitably, the mixing unit with the swivel arms can be laterally vertically adjusted for placement under or above the track in a simple and rapid manner so as to be movable between an operational position and an idle position in which the work vehicle travels from site to site. Suitably, the subgrade is torn up by the scarifying teeth at a same time additives are introduced into the cracks of the subgrade by providing the scarifying teeth with a channel which is in communication with an additive source via a feed conduit mounted to the machine frame and a flexible conduit. In this way, the process of scarifying or plowing the subgrade and introduction of additives becomes highly efficient and time saving.

In addition to introduction of additives via the scarifying teeth, the swivel arm is suitably provided with a plurality of sequentially arranged spray nozzles by which a water-lime mixture is sprayed over the subgrade layer from a suitable source via a feed conduit attached to the machine frame and a flexible conduit. Thus, without complicating the overall structure, the subgrade layer can be provided with a water-lime mixture for improving the load carrying capability. Suitably, provided on each longitudinal side of the work vehicle is a mixing unit which is preferably connected to the machine frame via a parallelogram guide mechanism and a load bearing member which is supported by the machine frame for rotation about a vertical axis. Thus, the mixing unit can be shifted easily and rapidly between an operational position and an idle position without requiring a time-consuming retrofitting of the arrangement.

According to another feature of the present invention, a compacting device is arranged rearwardly of the mixing unit in operating direction and in front of the discharge area of the ballast over the protective layer in order to level the soil immediately after blending the additives and to compact the subgrade to form a load-carrying layer. The compacting device is vertically adjustable to allow a precise control of the degree of compaction and includes a vibrating plate compactor which extends transversely to the track and is composed of two plates which are detachably secured together, with each plate being mounted to the machine frame at a longitudinal side thereof via a parallelogram guide mechanism. In this manner, the compacting device can be shifted between an operating position and an idle position in a very simple and rapid manner without requiring any modifications or retrofitting of the arrangement.

Suitably, a mounting is positioned behind the compacting device for holding a roller-type dispenser by which a plastic sheet is laid over the compacted protective layer across the entire subgrade. The plastic sheet is a water-impermeable membrane which may be reinforced on both sides by a net of polypropylene for increasing the strength to resist tear, and covers the entire subgrade at a width of about 5 m. In order to ensure a continuous operation of the work vehicle, the mounting holds three separate dispensers so that the installation of the plastic sheet is ensured even after one of the dispensers is emptied because at that point, the next dispenser is ready for use and continuous unwinding of the plastic sheet. Preferably, the work vehicle has a loading area for carrying a number of additional dispensers for replacement of spent dispensers.

In order to ensure that the track is sufficiently raised in the entire construction site to enable an unobstructed use of all components for the stabilization of the subgrade, the arrangement includes two track-lifting devices which are mounted to the machine frame, with one track-lifting device being arranged in an area immediately behind the excavating chain, and with the other track lifting device being positioned in an area between the mixing unit and the compacting device. This enables not only a sufficient raising of the track but also increases the safety aspect on the construction site.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
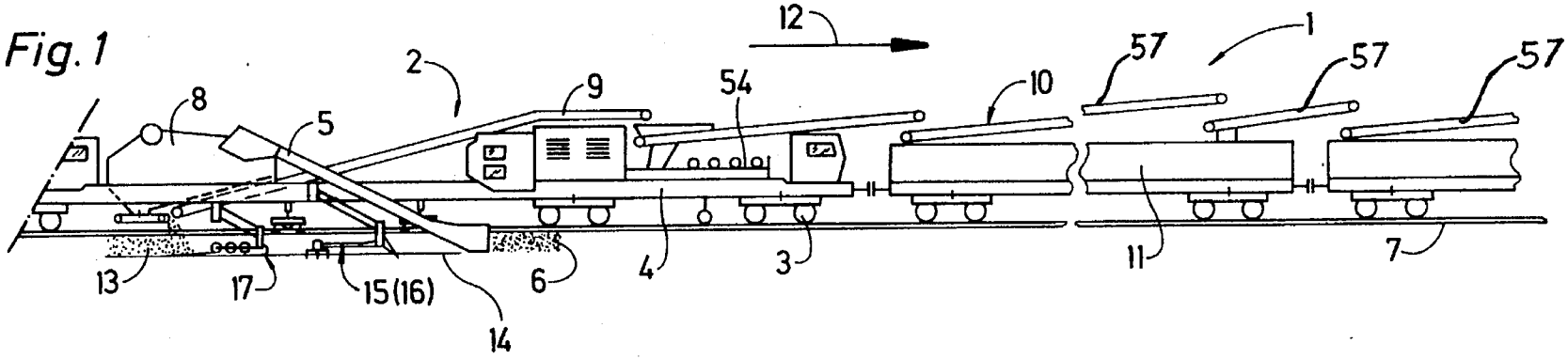
FIG. 1 is a side elevational view of a forward portion of one embodiment of a mobile track maintenance train according to the present invention, illustrating a ballast cleaning device in cooperation with a leading waste disposal car and a subgrade stabilizing unit immediately behind an excavating chain.

Throughout all the Figures, the same or corresponding elements are always indicated by the same reference numerals.

Figure 2:
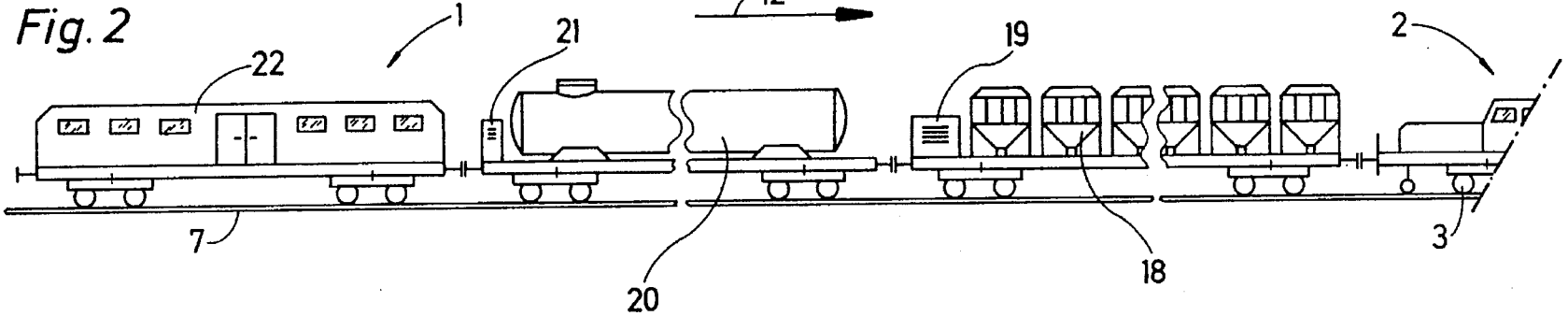
FIG. 2 is a side elevational view of a rearward portion of the track maintenance train with silo cars and tank car for transport of additives.

Referring now to the drawing, and in particular to FIGS. 1 and 2, there are shown respective side views of a forward portion and a rearward portion of a mobile track maintenance train, generally designated by reference numeral 1, for rehabilitation of a ballast bed 6 for a track 7. The track maintenance train 1 includes a central work vehicle 2 for ballast cleaning, having an elongated machine frame 4 supported on undercarriages 3 for movement along the track 7 in operating direction indicated by arrow 12. The machine frame 4 is provided with an excavation chain 5 by which ballast 6 is picked up and unloaded to a screen 8. Fouling material or waste is removed by the screen 8 and transported via a conveyer 9 to a waste disposal unit 10 which includes a number of like silo cars 11 connected to each other by continuous conveyer belts 57 and leading the work vehicle 2 in operating direction. In the area between the ballast withdrawal and ballast unloading area and immediately behind the excavating chain 5 are the working components for stabilizing a subgrade 14 which essentially include two mixing units 15, 16 and a compacting device 17 which will be described in more detail furtherbelow with reference to FIGS. 3 and 4.

As shown in FIG. 2, the track maintenance train 1 further includes hopper cars 18 which trail the work vehicle 2 and include a compressor unit 19 for supply of additives to the mixing units 15, 16. Trailing the hopper cars 18 is a tank car 20 with a pump station 21 as well as a service and repair car 22 which forms the end of the track maintenance train 1.

Figure 3:
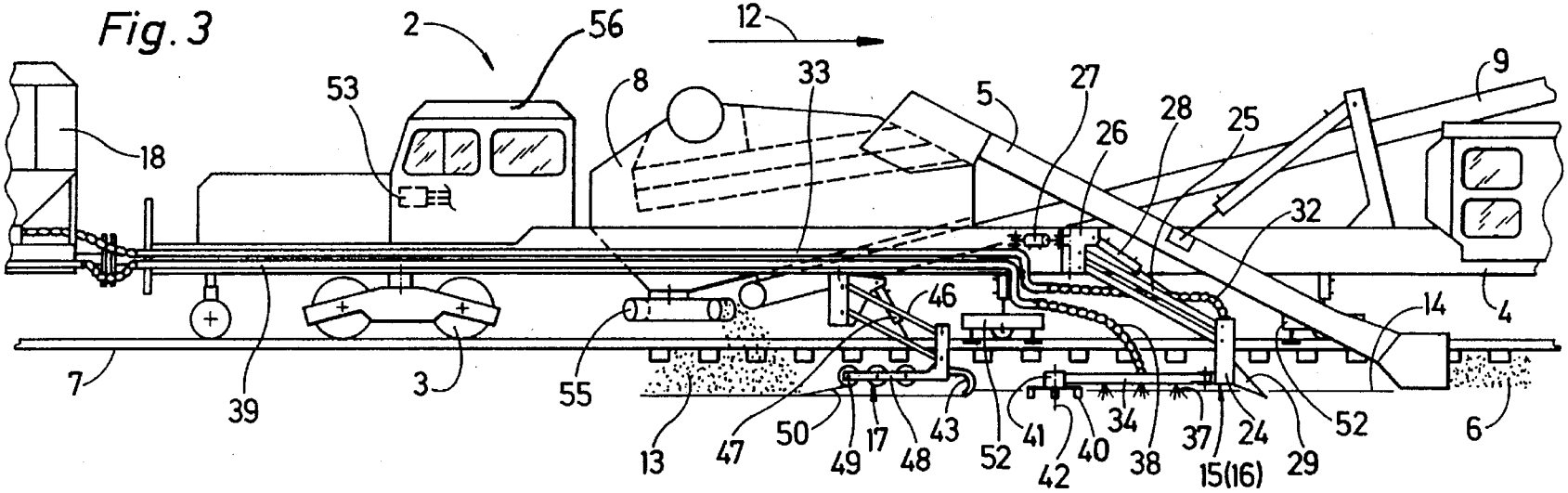
FIG. 3 is an enlarged side elevational view of the ballast cleaning device in the area of the stabilizing unit.
Figure 4:
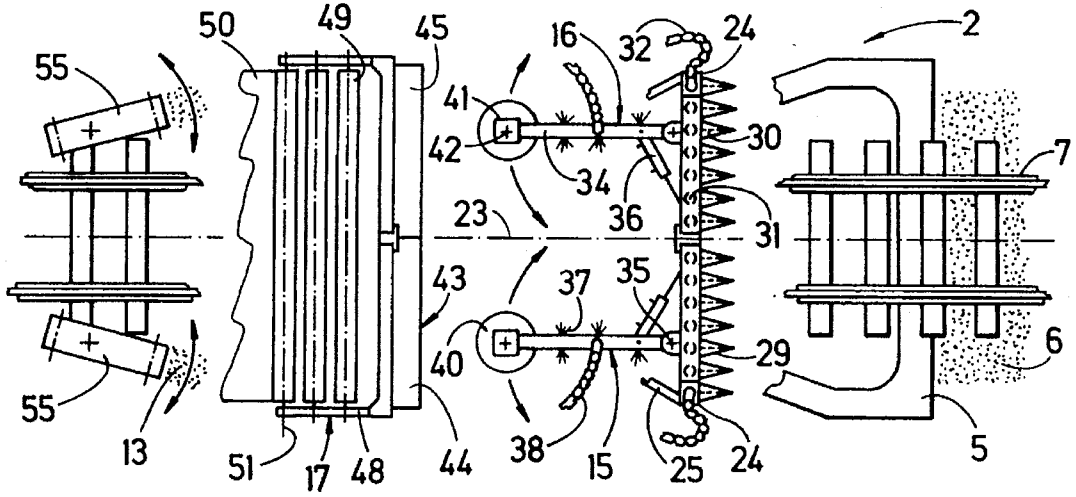
FIG. 4 a fragmentary plan view of the subgrade stabilizing unit.

As can be seen from FIGS. 3 and 4, the mixing units 15, 16 are arranged symmetrically to each other relative to the longitudinal axis 23 and mounted to the machine frame 4 in operating direction immediately behind the excavating chain 5. Each mixing unit 15, 16 is provided with a beam-like carrier frame 24 which extends transversely to the track 7. Both carrier frames 24 are detachably secured with each other at their abutting ends in the plane of the longitudinal axis 23 by a T-connector 58. The other end of each carrier frame 24 is articulated to a load-bearing member 26 via a parallelogram guide mechanism 25 in form of two parallel bars. Both load-bearing members 26 are supported on the machine frame 4 and rotatable about a vertical axis by means of a drive 27. A further drive 28 is provided for vertical adjustment of the mixing units 15, 16 relative to the machine frame 4 and is also secured to the load-bearing member 26

Arranged forwardly of the carrier frame 24 are trough-shaped scarifying teeth 29 which extend in side-by-side relationship transversely to the track 7 and are slanted downwardly and forwardly, as best seen in FIG. 3. Each scarifying tooth 29 includes a channel 30 which communicates with a pertaining port 31 in the carrier frame 24. A flexible conduit 32 at the outer end of each carrier frame 24 connects the channels 30 and their pods 31 of the pertaining carrier frame 24 via a feed conduit 33 which is laterally mounted to the machine frame 4 and communicates with the hopper cars 18 for supply of cement by means of the compressor unit 19.

Connected to each carrier frame 24 on the side distant to the scarifying teeth 29, is a horizontal swivel arm 34 which extends in operating direction laterally along machine frame 4 and is swingably mounted to the carrier frame 24 about a vertical axis 35. The free end of each swivel arm 34 is actuated by a drive 36 to swing in a horizontal plane back and forth and to enable each mixing unit 15, 16 to cover about half the width of the subgrade 14. Along its underside, each swivel arm 34 is provided with spray nozzles 37 which are directed downwards towards the subgrade 14 and connected to the tank car 20 via a flexible conduit 38 and a feed conduit 39 which is mounted to the machine frame 4 parallel to the feed conduit 33. Additive, e.g. clayey water, is supplied from the tank car 20 to the spray nozzles 37 by a pump station 21. The cantilevered end of each swivel arm 34 is provided with mixing elements 40 which project downwards and are rotatable about a vertical axis 42 by means of a drive 41.

The compacting device 17 is positioned in operating direction behind the mixing unit 15, 16 and is provided with a horizontal plate compactor 43 which extends transversely to the track 7 and includes two plates 44, 45 detachably secured with each other at their facing ends in the plane of the longitudinal axis 23. The outer ends of the plate compactor 43 are each articulated at a longitudinal side of the machine frame 4 via a parallelogram guide mechanism 46 in form of two parallel bars. A drive 47 effectuates the vertical adjustment of the compacting device 17 relative to the machine frame 4. The compacting device 17 is further provided with a mounting 48 for receiving three roller-type dispensers 49 for supply of a plastic sheet 50. The dispensers 49 are arranged sequentially in longitudinal direction, with their rotational axis 51 extending essentially parallel to the surface of the subgrade and transversely to the track 7 for installation of the plastic sheet 50 upon the stabilized subgrade 14. The plastic sheet 50 is a water-impermeable membrane and prevents the intermigration of subgrade 14 and ballast particles yet provides sufficient drainage. Such plastic sheets 50 are generally known and may be made of any suitable plastic material. For reinforcement, the plastic sheet 50 is reinforced on both sides by a net of polypropylene to increase the strength to resist tear.

The work vehicle 2 is further provided with two track lifting devices 52 by which the track 7 is raised and maintained in an elevated position in the area of the working components for stabilizing the subgrade 14 and to allow an unobstructed use of all components. One track lifting device 52 is positioned immediately behind the excavating chain 5 while the other track lifting device 52 is positioned in the area between the mixing unit 15, 16 and the compacting device 17.

After having described the individual parts of the track maintenance train 1 according to the present invention, its mode of operation will now be set forth:

At operation, the excavating chain 5 arranged underneath the track 7 removes during continuous advance of the work vehicle 2 the ballast 6 from the track 7 to expose the subgrade 14. Through actuation of the drives 27, 28, 36, 47, the scarifying teeth 29, the swivel arms 34 and the plate compactor 43 are pivoted into their operational position underneath the track 7. The subgrade 14 is plowed or loosened by the scarifying teeth 29 of the mixing unit 15, 16 to a depth of preferably about 30 cm while at the same time cement is introduced or injected through the channels 30 into the cracks or furrows of the loosened subgrade 14 by means of the compressor unit 19. Subsequently, calcareous concentrate mixed with water is supplied by the pump 21 from the tank car 20 to the spray nozzles 37 for depositing over the subgrade 14. In case the composition of the subgrade 14 is precisely known through respective samples, the amount of cement and lime can be automatically selected in order to attain a homogeneous equally strong protective layer between the subgrade and the ballast particles irrespective of the composition of the soil. Moreover, a control unit (not shown) may be provided to measure in the area of the plowed subgrade the moisture content of the soil and to determine the amount of water being added. The resulting mixture of soil, cement, lime and water is blended on site by the rotating mixing elements 40, with the drive 28 being precisely controlled by a control unit 53 mounted to an operator's cab 56 for regulating the thickness of the layer being blended as well as the depth of penetration of the scarifying teeth 29. Subsequently, the upper layer of the subgrade is consolidated by the compacting device 17, with the degree of compaction being controlled by drive 47. The slope of the subgrade surface, required for a proper drainage of the subgrade, is automatically created through respective inclination of the mixing units 14, 15 and the compacting device 17

After compacting the upper subgrade layer to form a stable protective layer, a water-impermeable plastic sheet 50 is laid from the dispenser 49 across the entire width of the subgrade 14, and cleaned ballast 13 is discharged by the oscillating ballasting bands 55. Once the entire plastic sheet 50 is rolled off from one dispenser 49, the continuous operation is maintained and uninterrupted by a second dispenser 49 on the mounting 48. Additional dispensers 49 are suitably stored in sufficient number on a loading area 54 of the work vehicle 2.

While the invention has been illustrated and described as embodied in a mobile arrangement for stabilizing a subgrade, it is not intended to be limited to the details shown since various modifications and structural changes may be made without departing in any way from the spirit of the present invention.

What is claimed as new and desired to be protected by Letters Patent is set forth in the appended claims:

We claim:

1. A method of stabilizing the subgrade of a track, comprising the steps of:

continuously removing ballast from underneath the track thereby exposing an upper layer of the subgrade;

scarifying the upper layer of the exposed subgrade for formation of cracks while disposing additives directly over the exposed subgrade and blending the additives with the subgrade underneath the track;

leveling and compacting the mixture of additives and subgrade for formation of a protective layer; and laying removed ballast over the protective layer.

2. The method of claim 1, further comprising the step of cleaning removed ballast before said laying step.

3. The method of claim 1, further comprising the step of introducing during said scarifying step the additives in the cracks.

4. The method of claim 3 wherein said introducing step includes disposing cement over the upper layers into the cracks of the subgrade, and blending, planing and compacting the upper cement-containing layers of the subgrade.

5. The method of claim 4 wherein said introducing step further includes spraying a mixture of water and lime over the cement-containing layers of the subgrade before said blending, planing and compacting steps.

6. The method of claim 5, further comprising the steps of continuously measuring the moisture content of soil in the area of scarified subgrade, and automatically controlling the amount of water being added in dependence of the measured moisture content.

7. The method of claim 1, further comprising the steps of laying a plastic sheet over the compacted protective layer and disposing ballast over the plastic sheet.

8. An arrangement for installing a protective layer between a subgrade and a layer of ballast of a track bed, comprising:

a machine frame for movement in an operating direction along a track;

excavating means mounted on said machine frame for removing ballast from underneath the track to thereby expose an upper layer of the subgrade;

subgrade stabilizing means trailing said excavating means in operating direction and being arranged underneath the track for directly introducing additives over the subgrade and blending the additives with the subgrade, said stabilizing means including a scarifying means for scarifying the upper layer of the subgrade for formation of cracks while adding said additives and a mixing unit having rotatable mixing elements which are immersible in the subgrade and a first drive for effectuating a vertical adjustment of said mixing unit; and conveyor means arranged on said machine frame for returning ballast to the track bed at an unloading area.

9. The arrangement of claim 8 wherein said scarifying means includes a plurality of scarifying teeth mounted to said machine frame immediately in front of said mixing unit and arranged in side-by-side relationship transversely to the track, and a second drive for vertical adjustment of said scarifying teeth to allow positioning of said scarifying teeth underneath the track.

10. The arrangement of claim 9 wherein said mixing unit includes a carrier frame for supporting said scarifying teeth.

11. The arrangement of claim 10 wherein said stabilizing means includes a swivel arm having one end articulated to said carrier frame of said mixing unit for rotation about a vertical axis by a third drive and another end, said mixing elements being mounted to said other end of said swivel arm for rotation about a vertical axis of said swivel arm by a fourth drive.

12. The arrangement of claim 11 wherein said stabilizing means includes a first additive source and passageway means for conducting an additive from said first source to the subgrade, said passageway means including a feed conduit mounted to said machine frame and communicating with said first source, a flexible conduit communicating with said feed conduit and a channel in each of said scarifying teeth in communication with said flexible conduit.

13. The arrangement of claim 11 wherein said swivel arm is provided with a plurality of spray nozzles arranged successively in operating direction, said stabilizing means including a second additive source and passageway means for conducting an additive from said second source via said spray nozzles to the subgrade, said passageway means including a feed conduit mounted to said machine frame and connected to said second additive source and a flexible conduit connected to said feed conduit and communicating with said spray nozzles.

14. The arrangement of claim 9 wherein said stabilizing means includes said mixing unit at each longitudinal side of said work vehicle.

15. The arrangement of claim 9 wherein said stabilizing means includes a support unit for pivoting the mixing unit, said support unit having a load-bearing member mounted to said machine frame for rotation about a vertical axis, and a parallelogram guide mechanism connecting said mixing unit to said load-bearing member.

16. The arrangement of claim 8, further comprising a compacting device extending underneath the track and trailing said stabilizing means in operating direction and situated before the unloading area of said conveyor means, said compacting device having a horizontal plate compactor extending transversely to the track and a drive for effectuating a vertical adjustment of said compacting device for positioning thereof underneath the track.

17. The arrangement of claim 16 wherein said plate compactor includes two plates which are detachably secured together, said compacting device including a parallelogram guide mechanism at each longitudinal side of said machine frame for mounting said plates to said machine frame.

18. The arrangement of claim 16, further comprising a plastic sheet dispenser for laying a plastic sheet across the entire width of the subgrade, said dispenser including a mounting, which is connected to said compacting device rearwardly of said plate compactor in operating direction, and being defined by a rotational axis extending essentially parallel to the surface of the subgrade and transversely to the track.

19. The arrangement of claim 18 wherein said mounting accommodates three such dispensers arranged in succession in operating direction.

20. The arrangement of claim 16, further comprising first and second track lifting devices for raising the track, said first track lifting device being mounted to said machine frame in an area immediately behind said excavating means in operating direction, and said second track lifting device being mounted to said machine frame in an area between said stabilizing means and said compacting device.

21. The arrangement of claim 18 wherein said work vehicle has a loading area for storing a number of additional plastic sheet dispensers.

* * * * *